US011088456B2

(12) United States Patent
Howarth et al.

(10) Patent No.: US 11,088,456 B2
(45) Date of Patent: Aug. 10, 2021

(54) CAVITY BACKED NOTCH ANTENNA WITH ADDITIVELY MANUFACTURED RADOME

(71) Applicant: BAE SYSTEMS Information and Electronic Systems Integration Inc., Nashua, NH (US)

(72) Inventors: Dean W. Howarth, Sudbury, MA (US); Michael J. Shaw, Epsom, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 79 days.

(21) Appl. No.: 16/545,031

(22) Filed: Aug. 20, 2019

(65) Prior Publication Data

US 2021/0057824 A1 Feb. 25, 2021

(51) Int. Cl.

| | |
|---|---|
| ***H01Q 1/42*** | (2006.01) |
| ***H01Q 9/27*** | (2006.01) |
| ***H01Q 1/40*** | (2006.01) |
| ***H01Q 1/38*** | (2006.01) |

(52) U.S. Cl.

CPC ..... *H01Q 9/27* (2013.01); *H01Q 1/38* (2013.01); *H01Q 1/405* (2013.01); *H01Q 1/42* (2013.01)

(58) Field of Classification Search

CPC ..... H01Q 1/243; H01Q 1/2283; H01Q 1/405; H01Q 1/42; H01Q 1/38; H01Q 9/27; H01Q 13/18; H01Q 21/065; H01Q 25/001; H01Q 1/02

See application file for complete search history.

(56) References Cited

U.S. PATENT DOCUMENTS

| | | | | |
|---|---|---|---|---|
| 3,633,210 A | | 1/1972 | Westerman et al. | |
| 4,387,377 A | * | 6/1983 | Kandler | H01Q 15/244 333/21 A |
| 6,842,154 B1 | | 1/2005 | Apostolos | |
| 8,654,017 B1 | * | 2/2014 | Voss | H01Q 1/02 343/705 |
| 8,674,899 B2 | | 3/2014 | Ando et al. | |

(Continued)

FOREIGN PATENT DOCUMENTS

| | | |
|---|---|---|
| EP | 3369132 | 5/2017 |
| GB | 2551840 A | 1/2018 |
| GB | 2558365 A | 7/2018 |

OTHER PUBLICATIONS

International Search Report, PCT/US20/46367, dated Oct. 27, 2020, 9 pages.

(Continued)

*Primary Examiner* — Haissa Philogene

(74) *Attorney, Agent, or Firm* — KPIP Law, PLLC; Scott J. Asmus

(57) ABSTRACT

The system and method for an additively manufactured radome for a cavity backed notch comprising at least one lattice structure wherein the antenna works over any 4:1 bandwidth, from VHF to mmW. In some cases, the radome lattice has a density that changes with distance from the antenna. In some cases multiple antennas are used for direction finding. The radome may be additively manufactured from glass-loaded polymer or other materials having a low dielectric constant. In some cases, the radome has a dielectric contract that approaches that of air.

12 Claims, 9 Drawing Sheets

(56) References Cited

U.S. PATENT DOCUMENTS

| | | | | |
|---|---|---|---|---|
| 8,773,323 | B1 * | 7/2014 | Manry, Jr. | H01Q 21/28 343/841 |
| 9,553,371 | B2 * | 1/2017 | MacDonald | H01Q 23/00 |
| 9,729,213 | B2 * | 8/2017 | Hartenstein | H01Q 1/2291 |
| 9,780,458 | B2 * | 10/2017 | Viscarra | H01Q 1/526 |
| 10,050,340 | B2 | 8/2018 | Merk | |
| 11,005,176 | B2 * | 5/2021 | Iluz | H01Q 1/422 |
| 2006/0017617 | A1 * | 1/2006 | McGrath | H01Q 9/30 343/700 MS |
| 2011/0074649 | A1 | 3/2011 | Isom et al. | |
| 2018/0013203 | A1 | 1/2018 | Wangsvick | |
| 2019/0232555 | A1 | 8/2019 | Shaw et al. | |
| 2020/0091608 | A1 * | 3/2020 | Alpman | H01Q 21/24 |

OTHER PUBLICATIONS

Kristoffersen et al., "3D printed metamaterial lenses for microwave antennas", FFI-RAPPORT, 17/00415, Norwegian Defence Research Establishment (FFI), Mar. 1, 2017.

* cited by examiner

CAVITY BACKED NOTCH ANTENNA WITH ADDITIVELY MANUFACTURED RADOME

FIELD OF THE DISCLOSURE

The present disclosure relates to radomes for antennas and more particularly to additively manufactured radomes.

BACKGROUND OF THE DISCLOSURE

Antenna radomes are often required to provide protection against environmental factors (e.g. wind, sand, water, heat, handling, etc.) for internal antenna components. However, careful design choices and material selection for the radomes must be made so as to not negatively impact the desired performance of the antenna. In traditional systems, the antenna radomes are often made from a very limited set of commercially-available materials which possess specific material properties conducive to the particular application. Even still, the use of these materials often imposes some level of performance degradation on the antenna itself. Fabrication processes associated with traditional radome materials often require numerous steps and are very labor intensive and require specialized tooling and facilities. Small form factors and particular applications further limit the application of conventional techniques.

Wherefore it is an object of the present disclosure to overcome the above-mentioned shortcomings and drawbacks associated with conventional cavity backed notch antennas.

SUMMARY OF THE DISCLOSURE

One aspect of the present disclosure is an antenna package, comprising: a cavity backed, exponentially tapered, capacitive fed, multiple layer PCB notch antenna; and an additively manufactured radome comprising at least one lattice structure, wherein the internal lattice structure is defined by volume packing of repeating periodic unit cells of polyhedron shapes, open truss structures, or any combination of the two.

In certain embodiments, the antenna can be scaled to work over any 4:1 bandwidth, from VHF to mmW.

One embodiment of the system of the radome is wherein the antenna is used for either a receive and/or a transmit application.

Another embodiment of the radome is wherein the antenna is a cavity backed notch antenna. In some cases, the antenna is a dielectric cone antenna. In certain embodiments, the antenna is a spiral antenna.

Yet another embodiment of the radome is wherein a first antenna is used with a second antenna to form a dual polarization antenna. In some cases, the multiple antennas are part of a direction finding system.

Still yet another embodiment of the radome is wherein a 90° hybrid antenna is added to create a circular polarized antenna. In some cases, the material used to additively manufacture the radome is a glass-loaded polymer.

One embodiment of the radome is wherein at least one gradient lattice structure has a spatially-varying density that changes with distance from the antenna to provide for beam forming and/or beam steering.

In another embodiment, the internal lattice structure is enclosed on one or more surfaces by a thin solid skin layer for the purposes of environmental protection.

In certain embodiments, the multiple layer PCB notch antenna is a three layer PCB notch antenna.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

In one embodiment, an unconventional size constraint and a requirement for a quadrant field of view (FOV) with gain greater than 0 dBi needed to be addressed. There, a traditional cavity back notch antenna would not have fit inside the required size envelope and still meet the design requirements. Using a typical molded polymer radome could possibly work mechanically, however, the dielectric constant of the material would load the antenna in a way that would decrease the overall bandwidth of the antenna and shrink it below the required 4:1 bandwidth. Therefore, a solution was required that would be both structurally sound and electrically compliant. One aspect of the present disclosure is a system comprising a single antenna used for either a receive and/or a transmit application. Another embodiment of the system of the present disclosure comprises multiple antennas as part of a direction finding system.

One embodiment of the present disclosure is a cavity backed notch antenna with an additive manufactured radome. In another embodiment, instead of a notch antenna a dielectric cone antenna could be used. In some cases, a spiral antenna could be used. An additional option is to add a second notch element crossed with the current element to create a dual polarization antenna. In certain embodiments, a 90° hybrid could be added to create a circularly polarized antenna.

In one embodiment, a radome according to the principles of the present disclosure improves the low end frequency response of the antenna without sacrificing a large amount of bandwidth. Given the volume constraints the antenna could not be made larger so a novel radome approach was required. This solution also takes into account coefficient of thermal expansion (CTE) mismatch issues as well as other environmental challenges, by using additive manufacturing to create an internally-latticed radome structure which provides the required strength and rigidity but allows some level of compliance to accommodate CTE mismatches in adjoining materials. If a solid polymer insert had been used, the Q of the antenna would have been increased too much, thus shrinking the overall bandwidth of the antenna below the requirements for the application and the solid rigid structure with a characteristically high CTE, would have been a mechanical engineering challenge.

Current solutions use traditionally manufactured radomes which either will sacrifice bandwidth because they are made of a bulk material with effective single discrete dielectric constant that is too high, or the material is too expensive. In addition, challenging volume constraints (i.e., small) require additional considerations. In one embodiment of the present disclosure, an efficient wideband small SWAP-C antenna is described.

Figure 1A:
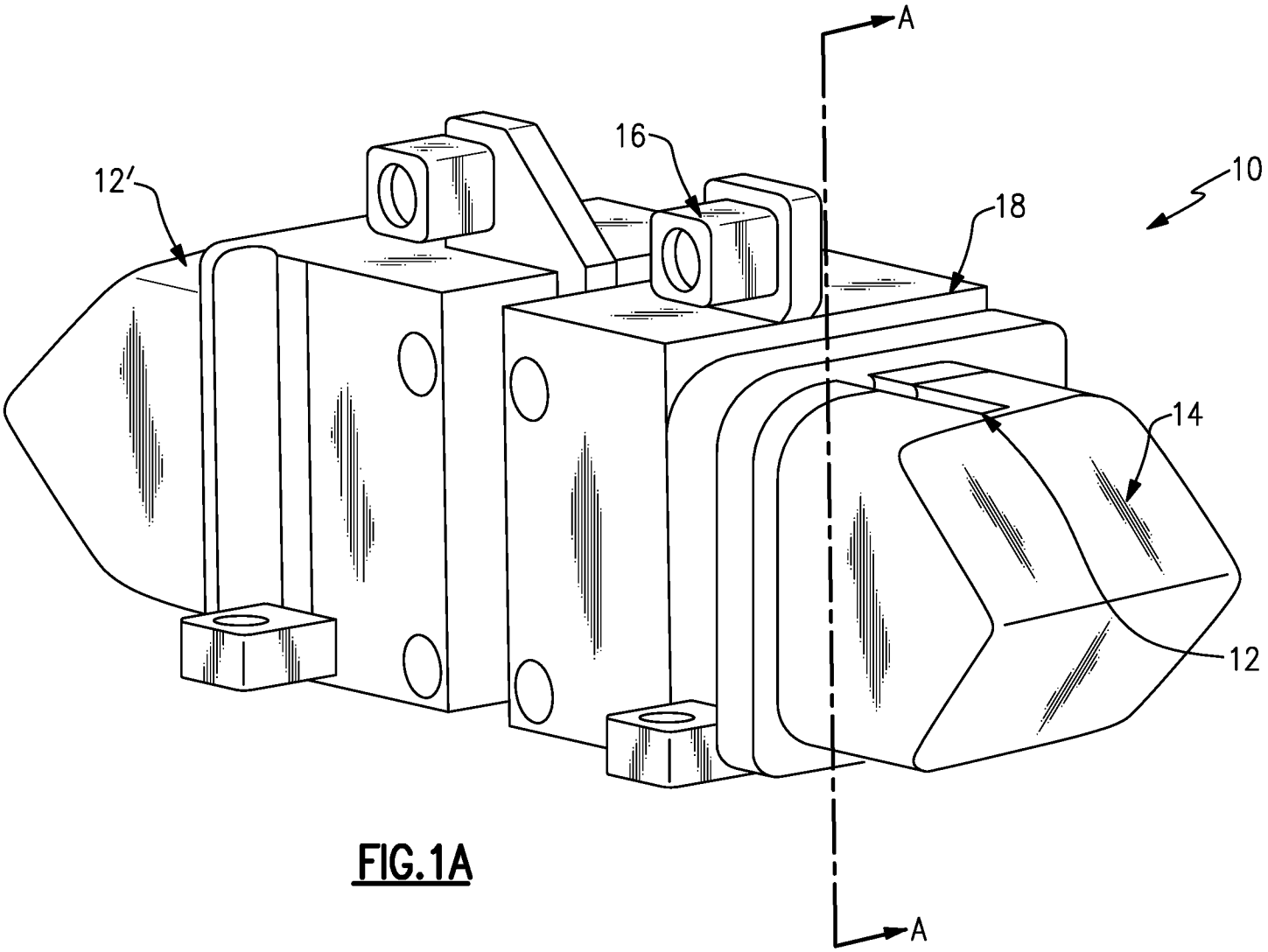
FIG. 1A shows a perspective view of a cavity backed notch antenna package comprising two antennas to provide for a broader field of view with one embodiment of an additively manufactured radome according to the principles of the present disclosure.

Referring to FIG. 1A, a perspective view of a cavity backed notch antenna package 10 comprising two antennas 12, 12' aligned so as to provide for a broader field of view. The package having one embodiment of an additively manufactured radome 14 according to the principles of the present disclosure. More specifically, one of the pair of antennas is described as a notch printed circuit board (PCB) antenna 12 with a connector 16 is shown with an additively manufactured radome 14 and within a housing 18 covering the antenna. In one embodiment, the radome must withstand extreme temperatures, altitude (where the material may expand and contract), and vibrations, among other environmental conditions. In some cases, the form factor for the antenna is very small.

In certain embodiments, the antenna design is frequency independent. It can be scaled to work over any 4:1 bandwidth, from VHF to mmW. This means that as long as all dimensional ratios are maintained it can be scaled to meet any 4:1 bandwidth.

Figure 1B:
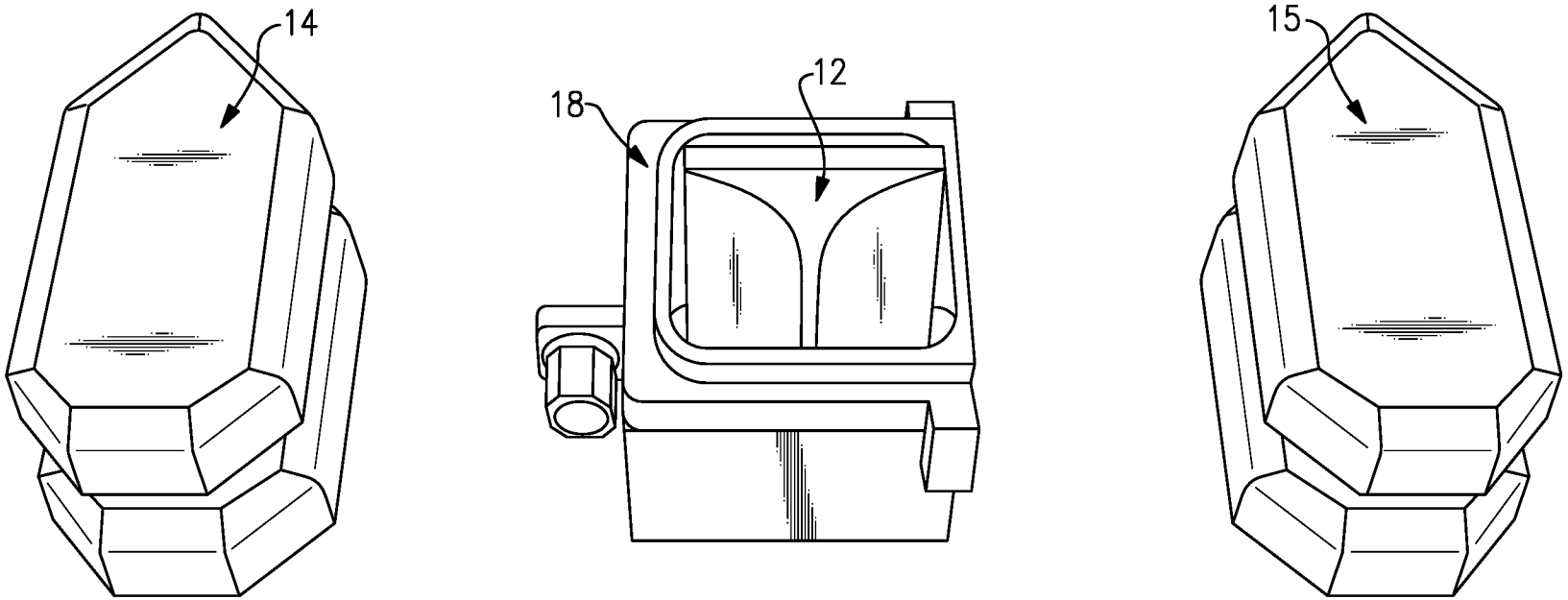
FIG. 1B shows a perspective view of a single cavity backed notch antenna package according to the principles of the present disclosure with one embodiment of an additively manufactured radome on the left and a conventional radome on the right.

Referring to FIG. 1B, a perspective view of a single cavity backed notch antenna package according to the principles of the present disclosure with one embodiment of an additively manufactured radome 14 on the left and a conventional radome 15 on the right is shown. In this figure, one embodiment of a notch PCB antenna 12 according to the principles of the present disclosure is shown within a housing 18.

On the left side of FIG. 1B, one embodiment of a lattice style additively manufactured radome 14 is shown. On the right side, a conventional radome 15 is shown. There, the radome is made of Rohacell low-dielectric foam. Prior systems use a solid foam, such as Rohacell, that can negatively affect the mechanical properties of the antenna. In some prior systems a high temperature polymer is used, but that provides only a 2:1 bandwidth. Another issue with conventional systems is the excess volume required.

Figure 2:
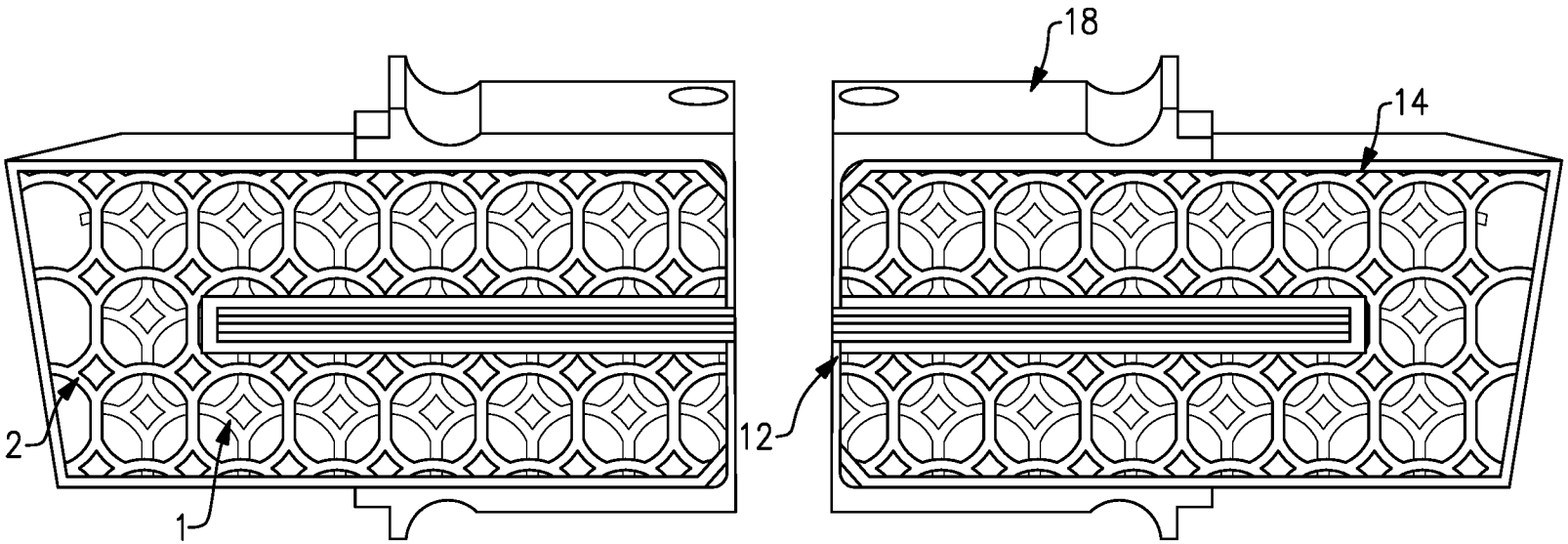
FIG. 2 shows a cross-sectional view of a single cavity backed notch antenna with one embodiment of an additively manufactured radome according to the principles of the present disclosure along AA in FIG. 1A.

Referring to FIG. 2, a cross-sectional view of one embodiment of the cavity backed notch antenna with an additively manufactured radome according to the principles of the present disclosure along AA in FIG. 1A is shown. More specifically, a notch printed circuit board (PCB) antenna 12 is shown within a housing 18 with a lattice style additively manufactured radome 14. Details of one embodiment of the notch printed circuit board (PCB) antenna of the present disclosure will be shown in FIGS. 3A-3C. The additively manufactured radome is used to protect the antenna elements so that they are not exposed to the environment as well as provide structural reinforcement. Additionally, the radome of the present disclosure needs to have a dielectric constant that approximates air so as to not interfere with the optimal operation of the antenna. In one embodiment the radome 14 comprises an engineered sparse latticed glass-loaded polymer structure. Here, positive space and negative space create a lattice structure have multiple layers 1, 2. In some cases, the additively manufactured radome may have a lattice type structure with a variety of different unit cells.

Figure 3A:
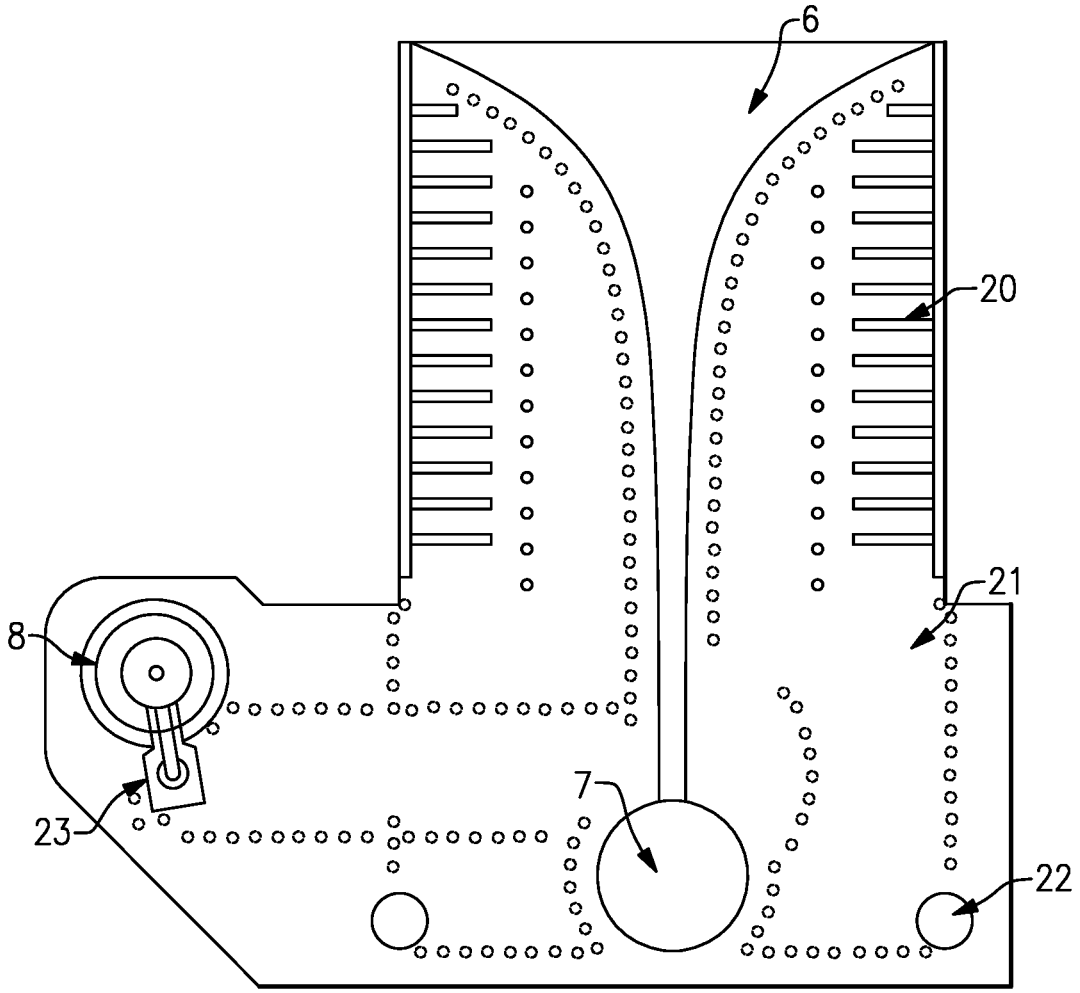
FIG. 3A shows a connector side view of details for one embodiment of a notch PCB antenna according to the principles of the present disclosure.

Referring to FIG. 3A, a connector side view of details for one embodiment of the notch PCB antenna according to the principles of the present disclosure is shown. More specifically, this includes a board 6, etched artwork 21 and a connector 8. This is the PCB 6 seen from a side view in FIG. 2. In certain embodiments, the etched copper artwork 21 of the notch is an RF choke. At low frequencies, the currents wrap around the notch and bounce off the cavity 7 causing destructive interference. This artwork was a way to perturb those currents and prevent the interference. In certain embodiments, holes 22 that are used for mounting the board inside the cavity are shown. The connector 8 is the same connector shown in FIG. 2 (16). In some cases, the center conductor of the connector solders to a pad 23.

Figure 3B:
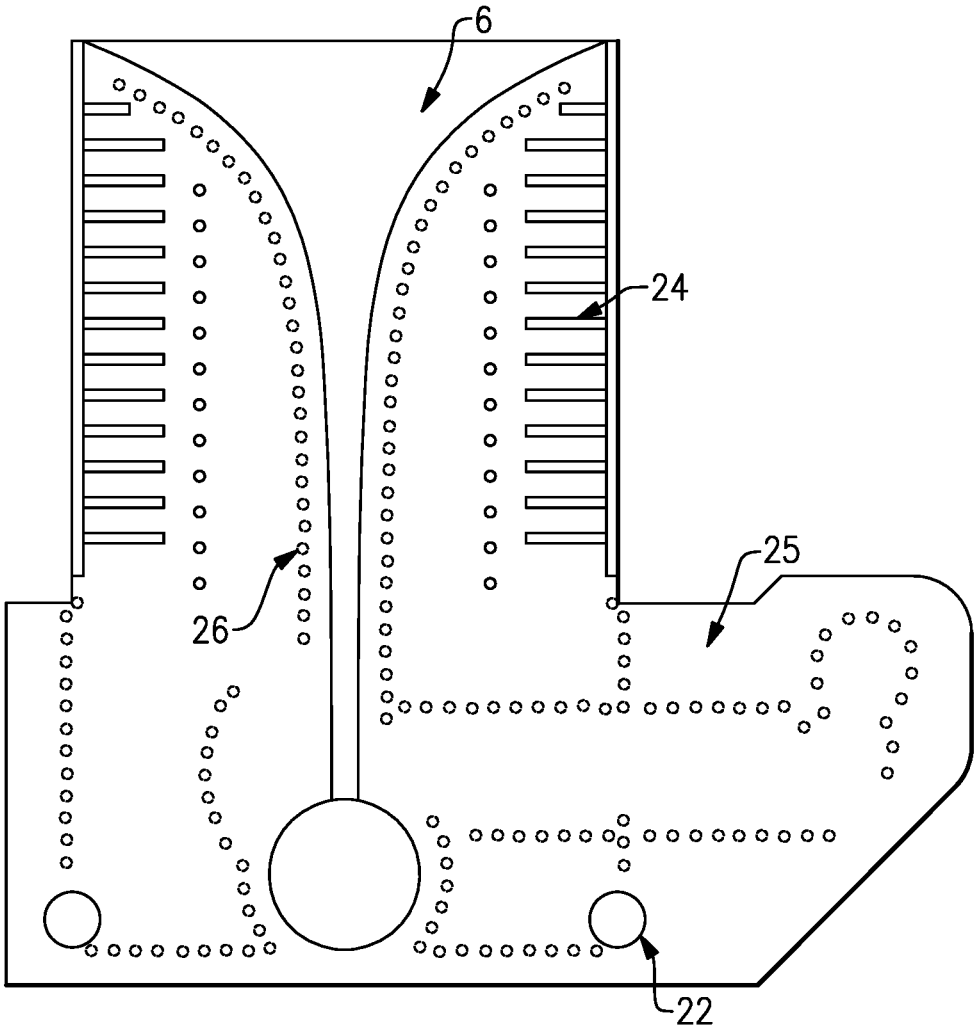
FIG. 3B shows a back side view of details for one embodiment of a notch PCB antenna according to the principles of the present disclosure.

Referring to FIG. 3B, a back side view of details for one embodiment of a notch PCB antenna according to the principles of the present disclosure is shown. More specifically, an image of the back side of the PCB includes the PCB antenna 6, etched artwork 25, and vias 26 that go all the way through the board. As noted previously, 24 is an RF choke. In this view, the vias 26 are visible. These vias go through all three layers (FIGS. 3A-3C) and electrically connect all three layers.

Figure 3C:
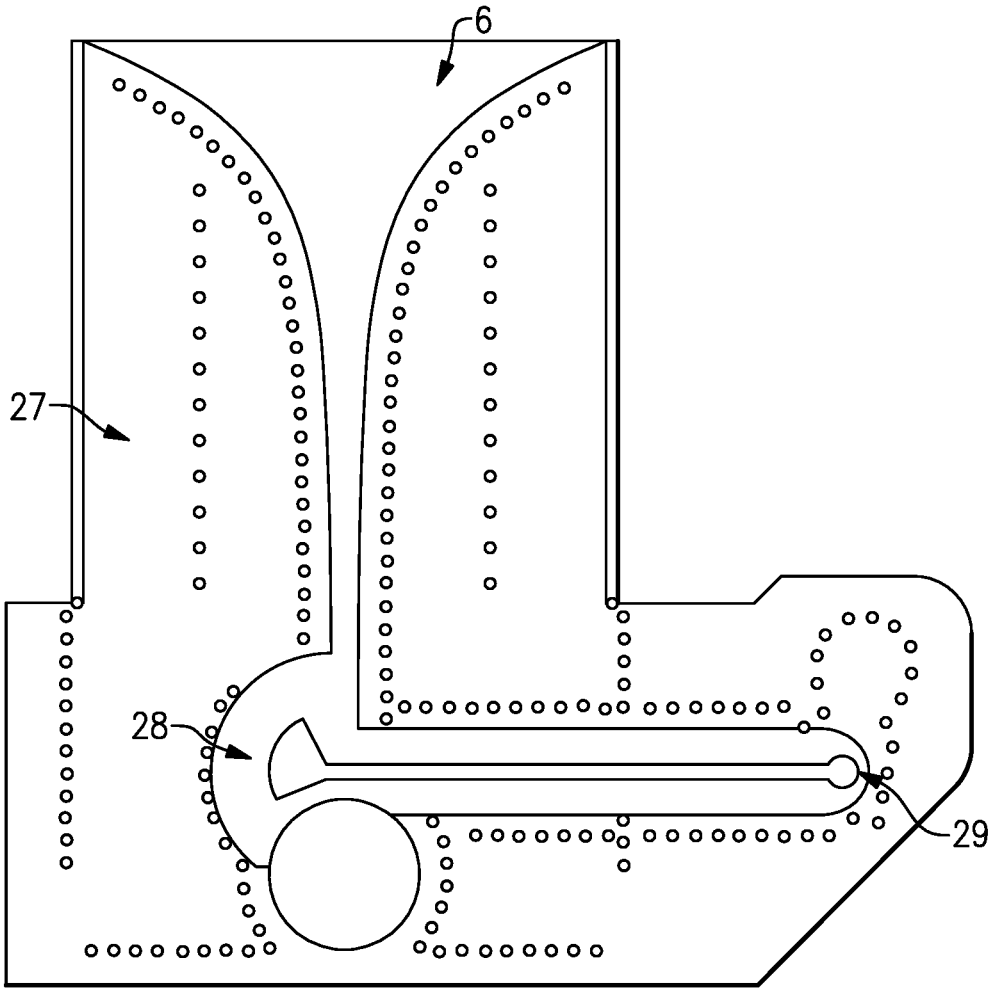
FIG. 3C shows a center layer detail for one embodiment of a notch PCB antenna according to the principles of the present disclosure.

Referring to FIG. 3C, a center layer detail for one embodiment of a notch PCB antenna according to the principles of the present disclosure is shown. More specifically, an image of the center layer of the PCB includes the PCB antenna 6, etched artwork 27, as well as the vias that go all the way through. In this figure, 27 is the etched ground layer and the feed trace 28, or center feed, is terminated in a quarter-wave stub. In this embodiment, it is not physically connected to the ground of the other two layers. The connector 8, as seen in FIG. 3A, has a via that connects to the feed trace 28 at the location marked 29.

Figure 4:
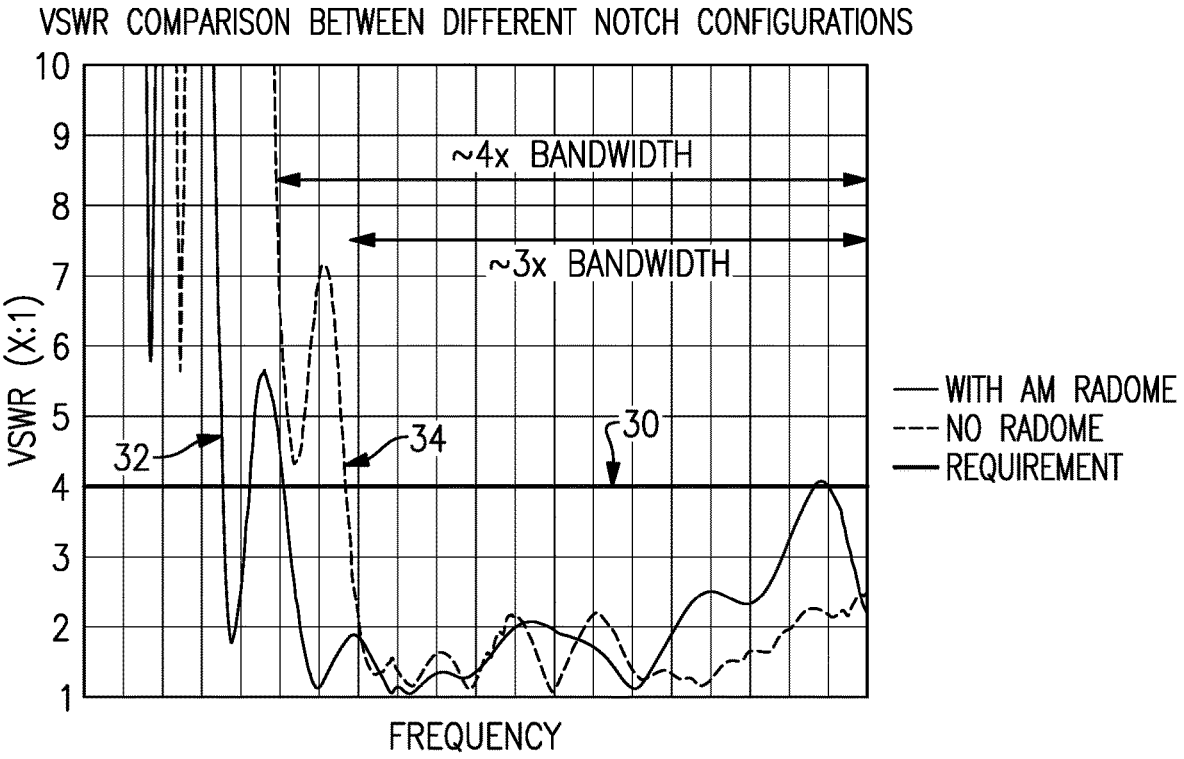
FIG. 4 shows a plot of Voltage Standing Wave Ratio (VSWR) versus frequency for a cavity backed notch antenna with and without an additively manufactured radome according to the principles of the present disclosure.

Referring to FIG. 4, a plot of Voltage Standing Wave Ratio (VSWR) versus frequency for a cavity backed notch antenna with and without an additively manufactured radome according to the principles of the present disclosure is shown. More specifically, the plot shows a first line 30 that marks the particular requirement for a VSWR less than 4 for the system across a 4:1 frequency bandwidth. The VSWR across frequency was plotted for a cavity backed notch antenna with one embodiment of the additively manufactured radome of the present disclosure 32, and without a radome 34. It is possible to see that the additively manufactured radome of the present disclosure 32 actually performs better than air. It has a 4× bandwidth as compared to a 3× bandwidth for a bare antenna at these frequencies.

The depth of the cavity and the maximum length of the notch were set by the allocated volume of the system. The flare of the notch on the matching balun were designed to shape the antenna pattern for the required FOV and impedance match to 50 Ohms. Since the shape of the notch provided the correct FOV antenna patterns, a tapered density lattice structure was not needed for this particular application. However, if a broadened beam or narrowed beam was desired, changing the density of the lattice in relation to the notch could be done. The lowest overall volume ratio of polymer-to-air was chosen which satisfied both the need to achieve the largest bandwidth possible and satisfy mechanical structural requirements. To achieve performance at the required lowest frequency, a heavier loading was not required.

Figure 5A:
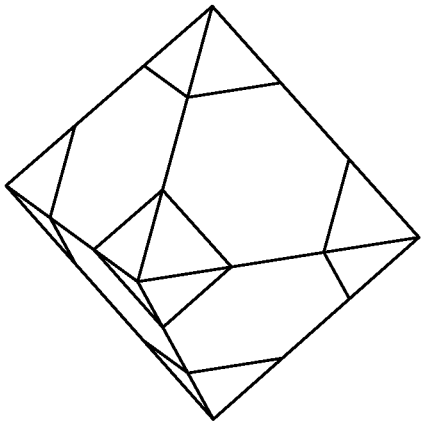
FIG. 5A shows one embodiment of a polyhedron according to the principles of the present disclosure.
Figure 5B:
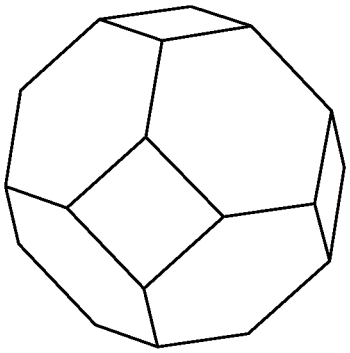
FIG. 5B shows one embodiment of a truncated polyhedron according to the principles of the present disclosure.

Referring to FIG. 5A, one embodiment of a polyhedron according to the principles of the present disclosure is shown. Referring to FIG. 5B, one embodiment of a truncated polyhedron according to the principles of the present disclosure is shown.

Figure 6:
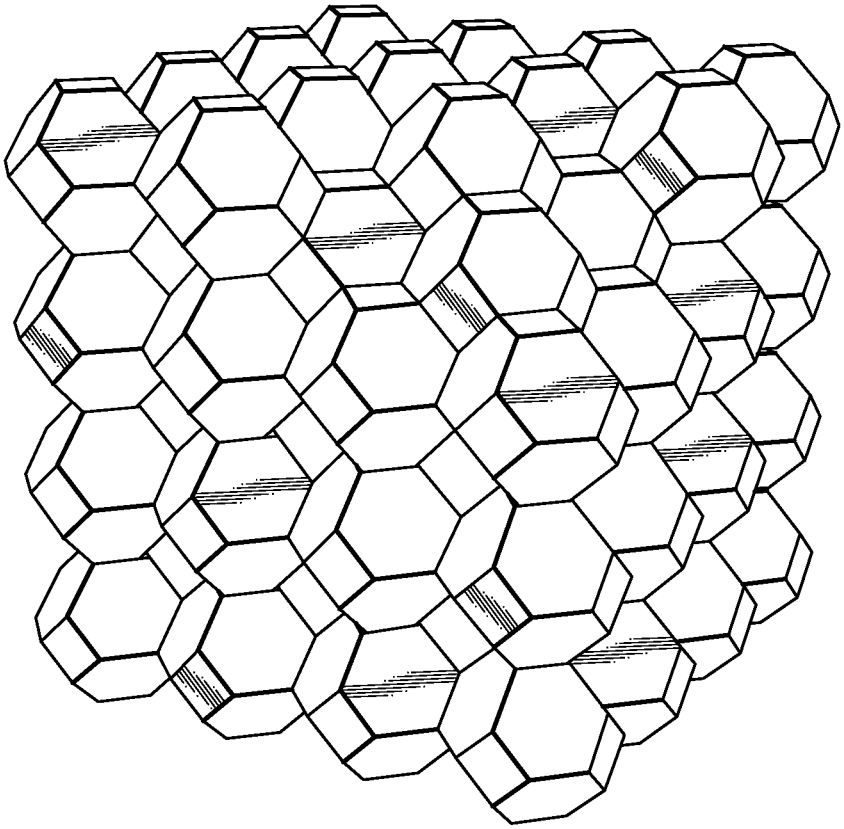
FIG. 6 shows one embodiment of a space-filling tessellation of a truncated octahedron filling an arbitrary volume according to the principles of the present disclosure for an additively manufactured radome for a cavity backed notch antenna package.

Referring to FIG. 6, one embodiment of a space-filling tessellation of a truncated octahedron filling an arbitrary volume according to the principles of the present disclosure for an additively manufactured radome for a cavity backed notch antenna package is shown. More specifically, in one embodiment, the internal volumetric sparse lattice structure is based on simple cubic packing of unit cells in the shape of a truncated octahedron with physical dimensions that are tailorable to achieve specific required RF properties. The truncated octahedron fills an arbitrary volume in such a way that only four solids meet at each vertex. It is also semi-regular meaning that its faces are equiangular and equilateral polygons. There is no other solid having this unique combination of properties and thus it results in the simplest decomposition of space in congruent parts.

It is understood that a variety of different lattice structures are possible and might be suited for particular applications including, but not limited to, other complex polyhedral-based unit cells as well as periodic open truss structure unit cells. In certain embodiments, the lattice density changes from low to high or high to low as it moves away from a notch PC board to act as a lens and change the beam shape, as desired. In some cases, the overall density can be increased if a higher effective dielectric constant is required.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. An antenna package, comprising:

a cavity backed, exponentially tapered, capacitive fed, multiple layer printed circuit board (PCB) notch antenna; and an additively manufactured radome comprising at least one lattice structure, wherein an internal lattice structure is defined by volume packing of repeating periodic unit cells of polyhedron shapes, open truss structures, or any combination of the two, wherein the at least one lattice structure has a spatially-varying density that changes with distance from the antenna to provide for beam forming and/or beam steering.

2. The antenna package according to claim 1, wherein the cavity backed notch antenna is scaled to work over any 4:1 bandwidth, from very high frequency (VHF) to millimeter wave (mmW).

3. The antenna package according to claim 1, wherein the antenna is used for a receive and/or a transmit application.

4. The antenna package according to claim 1, wherein a first antenna is used with a second antenna to form a dual polarization antenna.

5. The antenna package according to claim 3, wherein multiple antennas are part of a direction finding system.

6. The antenna package according to claim 3, wherein a 90° hybrid antenna is added to create a circular polarized antenna.

7. The antenna package according to claim 1, wherein the antenna is a dielectric cone antenna.

8. The antenna package according to claim 1, wherein the antenna is a spiral antenna.

9. The antenna package according to claim 1, wherein a material used to additively manufacture the radome is a glass-loaded polymer.

10. The antenna package according to claim 1, wherein the multiple layer PCB notch antenna is a three layer PCB notch antenna.

11. The antenna package according to claim 1, wherein the internal lattice structure is enclosed on one or more surfaces by a thin solid skin layer for the purposes of environmental protection.

12. An antenna package, comprising:

a cavity backed, exponentially tapered, capacitive fed, multiple layer printed circuit board (PCB) notch antenna; and an additively manufactured radome comprising at least one lattice structure, wherein an internal lattice structure is defined by volume packing of repeating periodic unit cells of polyhedron shapes, open truss structures, or any combination of the two, wherein the internal lattice structure is enclosed on one or more surfaces by a thin solid skin layer for purposes of environmental protection.

* * * * *